US006298584B1

(12) United States Patent
Bauvois

(10) Patent No.: US 6,298,584 B1
(45) Date of Patent: Oct. 9, 2001

(54) SKI BOOT

(75) Inventor: Jean Bauvois, Villard de Lans (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/332,316

(22) Filed: Jun. 14, 1999

(30) Foreign Application Priority Data

Jul. 3, 1998 (CH) ..... 1433/98

(51) Int. Cl.[7] ..... A43B 5/04
(52) U.S. Cl. ..... 36/118.7; 36/118.2; 36/117.1
(58) Field of Search ..... 36/118.1, 118.2, 36/118.7, 118.8, 118.9, 50.5, 118.3, 118.4, 118.5, 117.1

(56) References Cited

U.S. PATENT DOCUMENTS

| | | | | |
|---|---|---|---|---|
| 4,761,899 | * | 8/1988 | Marxer | 36/118.7 |
| 4,839,973 | | 6/1989 | Dodge . | |
| 5,107,608 | | 4/1992 | Kreitenberg . | |
| 5,283,964 | * | 2/1994 | Chemello | 36/118.7 |
| 5,457,899 | * | 10/1995 | Chemello | 36/118.7 |

FOREIGN PATENT DOCUMENTS

| | | |
|---|---|---|
| 0 410 136 | 1/1991 | (EP) . |
| 0 514 762 | 11/1992 | (EP) . |
| 2 063 622 | 7/1971 | (FR) . |
| WO 97/22271 | 6/1997 | (WO) . |

OTHER PUBLICATIONS

International Search Report In SN 1433/98 Switzerland.

* cited by examiner

*Primary Examiner*—Paul T. Sewell
*Assistant Examiner*—Jila Mohandesi
(74) *Attorney, Agent, or Firm*—Bugnion S.A.; John Moetteli

(57) ABSTRACT

The boot has a cuff (4) articulated to a shell (1) and means for retaining the cuff which counteract the rearward tilting of the cuff but give way when the force tilting the cuff exceeds a specific value. These means consist essentially of a ramp (12) which is integral with the shell or the other component of the boot and against which a bearing element (8) integral with the cuff bears. The ramp and the bearing element can push one another against the action of a spring (9). An escape position allows the cuff to tilt. Such a boot is intended to prevent tearing of the anterior cruciate ligament of the knee.

4 Claims, 4 Drawing Sheets

Fig.4
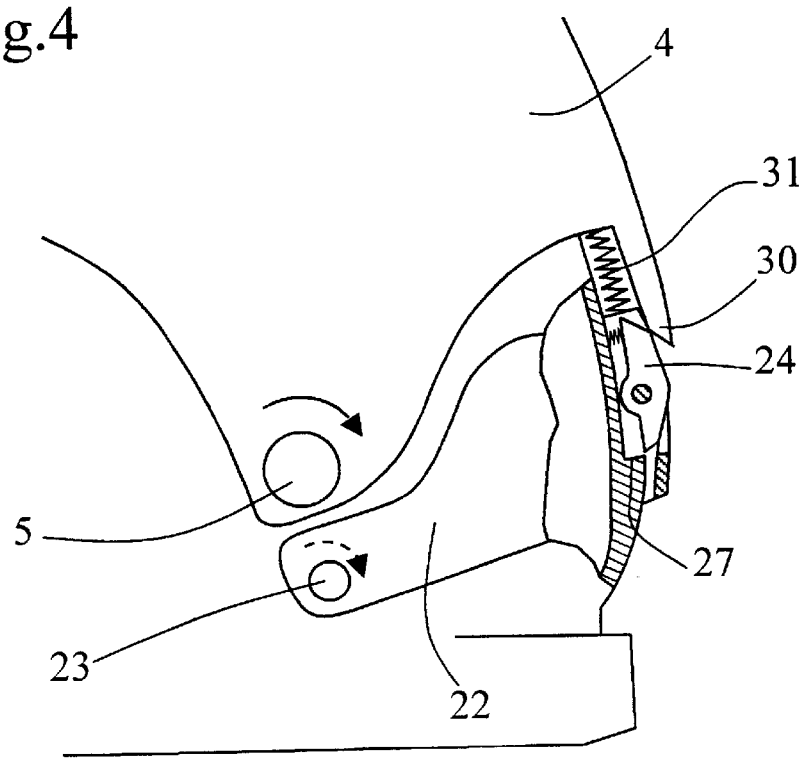
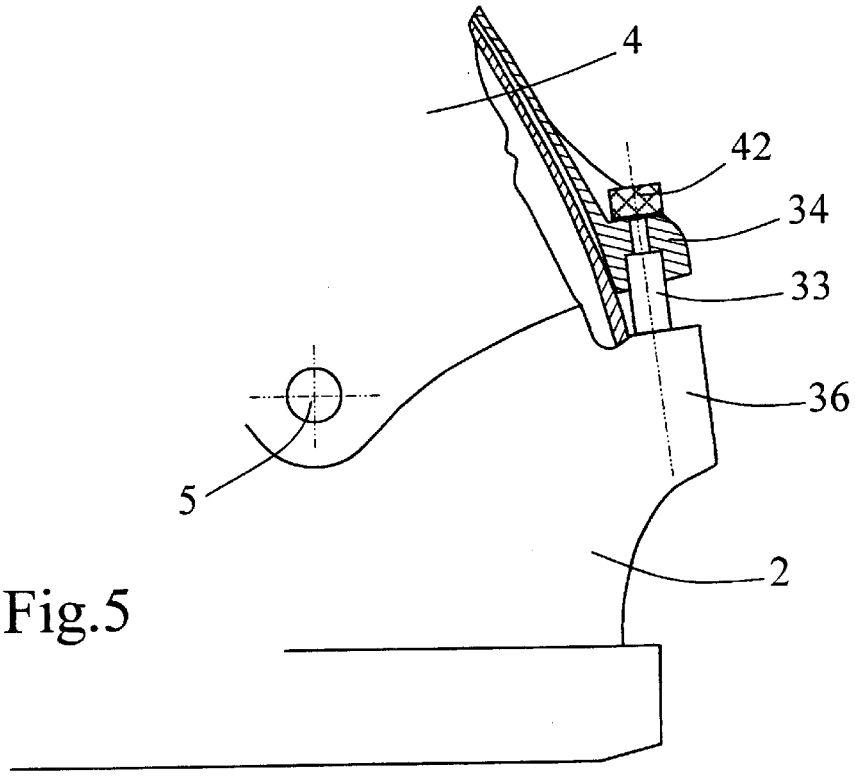
Fig.5

Fig.6
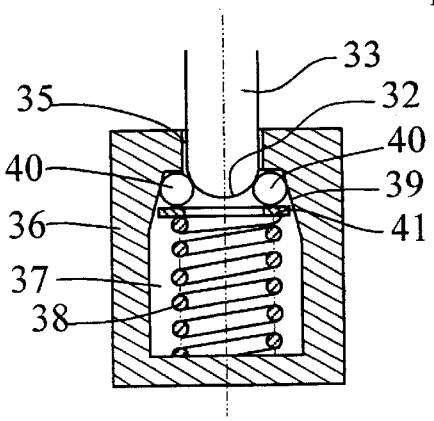
Fig.7
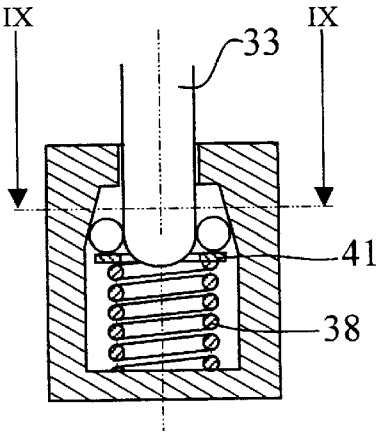
Fig.8
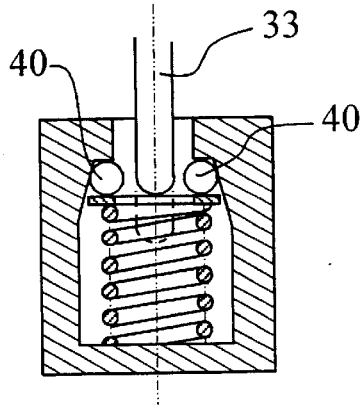
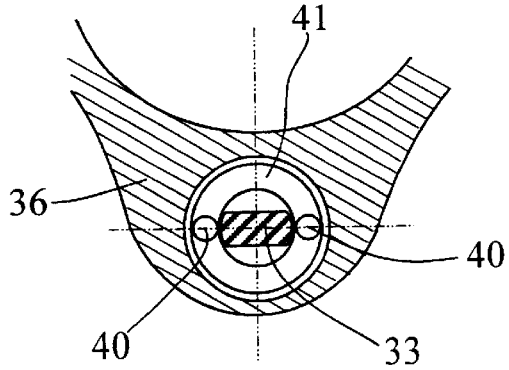
Fig.9

SKI BOOT

BACKGROUND OF THE INVENTION

The present invention relates to a ski boot comprising a first component, consisting essentially of a sole and an upper which encloses the foot and the malleolar region, and a second component consisting of a cuff which is articulated with respect to the upper so as to allow the cuff to move from front to rear and vice versa, and means for retaining the cuff which counteract the rearward tilting of the cuff but give way when the force tending to tilt the cuff exceeds a specific value.

The purpose of such a design is to protect the skier's knee, and more precisely the anterior cruciate ligament, when an excessive forward force is exerted on the tibia relative to the femur. It has been observed that tears of the anterior cruciate ligament due to an excessive force of this type have become much more widespread while other types of injury, in particular broken legs and ankles have become much less frequent because of the progress made with safety bindings. Excessive force on the anterior cruciate ligament occurs, in particular, when going over a bump, either when jumping, on landing, or when going down the bump again quickly.

U.S. Pat. No 5,107,608, the content of which is incorporated by reference, has already disclosed a boot equipped with a releasable retaining device intended to protect the anterior cruciate ligament in case of excessive force. This device comprises a latch in the form of a bent lever of the first class which is retained by a spring. In case of excessive force on the cuff, the spring will no longer be capable of retaining the latch, which will tilt and free the cuff. Such a device has the drawback that the skier cannot put it back into its initial position. It is also relatively bulky.

International Patent Application WO 97/22 271, the content of which is incorporated by reference, moreover discloses a ski boot which is also equipped with a retaining device which releases in case of excessive force on the cuff, rearward. This device consists of a sprung linkage, the articulation of which has enough play to allow the articulation pin some degree of longitudinal movement in the lower element of the linkage, and the elements of which abut, at a point lying some distance from the articulation pin, at the end of a travel smaller than the possible displacement of the pin. Once the elements of the linkage have come to abut and the spring of the linkage has already undergone some degree of compression, if the force on the cuff continues to increase then the elements of the linkage will pivot about their bearing point and the linkage will release if its articulation moves beyond alignment of the points of articulation of the linkage to the upper and to the cuff. This device has the advantage that the skier can put it back into its initial position, but it is relatively complex and bulky.

With the aim of protecting the anterior cruciate ligament of the knee, it has also been proposed to introduce a simple spring into a ski boot closure device, joining the rear cuff to the shell of a rear entry boot (European Patent No 0,410,136, the content of which is incorporated by reference). The corresponding published patent application deals with a safety device which opens the closure device of the boot, but the document does not give any examples of embodiments.

Also for a rear entry boot, European Patent Application No 0,514,762, the content of which is incorporated by reference, describes releasable protective devices which are mounted on the front cuff or on the shell and which free a strap or a closure cable of this cuff when pressure on the rear cuff exceeds a specific value.

SUMMARY OF THE INVENTION

The object of the invention is to produce retaining means based on a different principle which can be implemented by simple and compact means.

The boot according to the invention is one wherein the retaining means consist essentially of a ramp which is integral with one of the components of the boot and against which a bearing element integral with the other component of the boot bears, the ramp and the bearing element being capable of pushing one another against the action of an elastic means so as to allow the cuff to tilt, said retaining means having an escape position allowing the cuff to tilt freely rearward.

In the case of a boot whose cuff is articulated to the upper in the malleolar region, the ramp may for example be formed on the back of the upper and interact with a retractable finger mounted on the cuff.

According to another embodiment, in which the boot is equipped with a stirrup which surrounds the heel and is articulated in the malleolar region above the cuff, the ramp may be formed at the upper end of a catch for retaining the stirrup and the bearing element may consist of the lower edge of the cuff, tilting the catch allowing it to escape from its stop and the stirrup and the cuff to tilt.

According to another embodiment, the ramp consists of the rounded end of a finger integral with the cuff, at the rear of this cuff and directed downward, and the bearing element consists of at least two balls which are retained laterally by opposing ramps that diverge upward and are held at the top of the latter by the thrust of a spring so as to oppose passage of the finger, as long as the spring has not been compressed so as to allow the balls to move apart and the finger to pass through.

The invention is also applicable to a boot whose cuff is articulated by its lower rear end to the upper. In this case, the ramp may be formed on a hook-shaped end of at least one lever mounted so as to pivot on at least one side of the upper, the bearing element consisting of a pin or the like which is integral with the cuff and whose pressure exerted on the ramp tends to make the lever pivot rearward until escaping from its hook.

In all cases, the safety retaining device can be reset by the user.

BRIEF DESCRIPTION OF THE DRAWING

The appended drawing represents a few embodiments of the invention by way of example.

FIG. 4 represents the same boot in the rear release position.

FIG. 5 is a cutaway of the rear part of a boot according to a fourth embodiment.

FIGS. 6 and 7 represent, in axial section, the device for retaining the boot represented in FIG. 5, respectively in the retaining position and in the release position.

FIG. 8 represents the retaining device put in the inactive position for resting or walking.

FIG. 9 is a view in section on IX—IX FIG. 7.

DETAILED DESCRIPTION OF THE PREFERRED EMBODIMENTS

Figure 1:
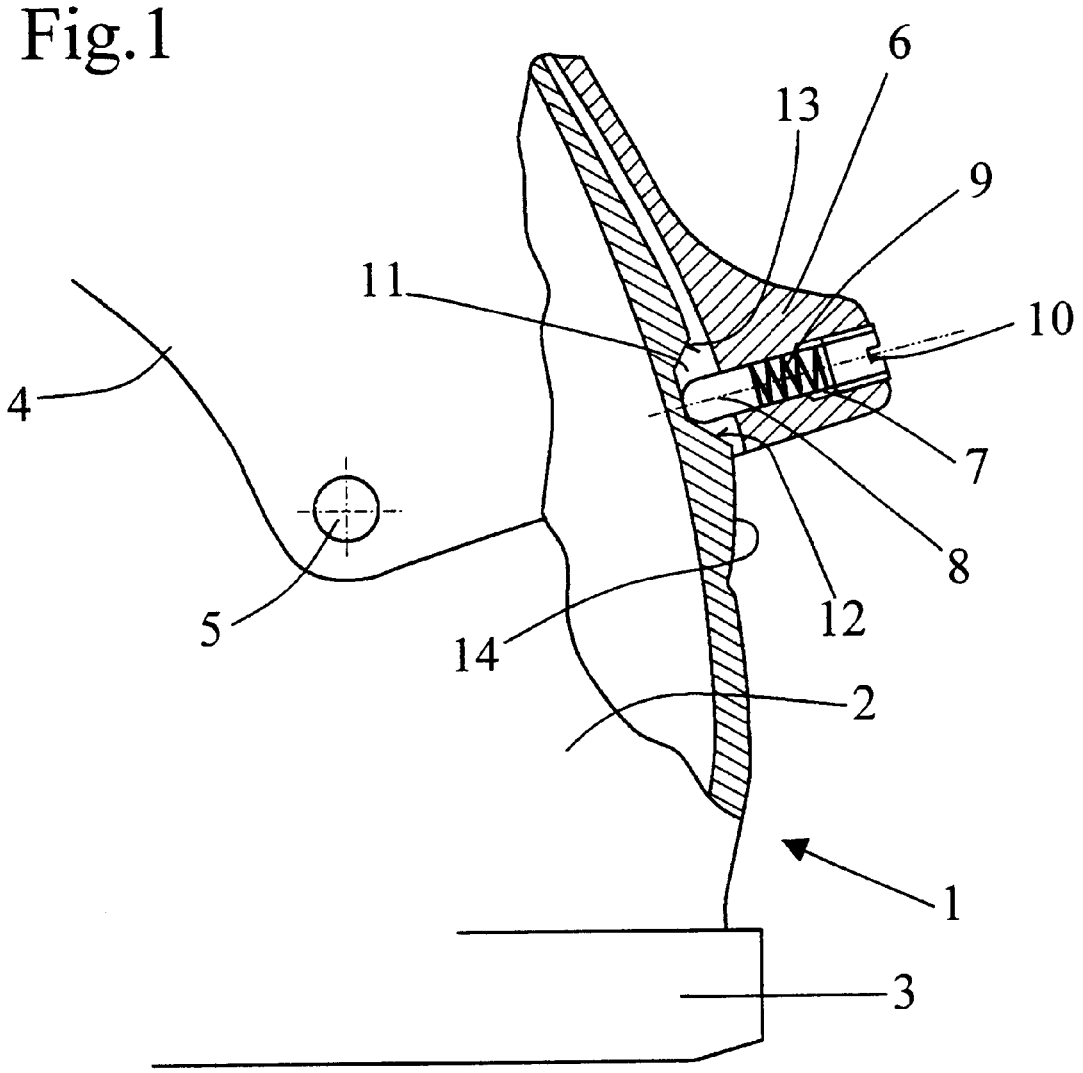
FIG. 1 is a cutaway of the rear part of a ski boot represented partially, according to a first embodiment.

The ski boot whose rear part is represented in FIG. 1 consists essentially of a shell 1 forming the upper 2 and the sole 3 of the boot, the upper 2 extending substantially over the malleolar region, and a cuff 4 articulated to the upper 2 at two opposite points 5 in the malleolar region. The rest of the boot can be produced in any known way, the upper and the cuff being generally provided with buckles for closure and tightening. The posterior lower edge of the cuff 4 has an extra thickness 6 in which a hole 7 is formed, the axis of which is directed substantially perpendicular to the surface of the upper 2, in the longitudinal mid-plane of the boot. A retractable finger 8, subjected to a thrust by a spring 9 bearing on a screw-threaded plug 10, that is to say a screw allowing the precompression of the spring 9 to be modified, is mounted in this hole 7. The retractable finger 8 bears against the bottom of a recess 11 formed in the thickness of the upper 2. The recess 11 is bounded at the bottom by a first ramp 12 and at the top by a second ramp 13. In the position represented in the drawing, the cuff is slightly inclined forward. When the cuff tries to straighten up, the finger 8 comes to bear against the bottom of the ramp 12. When a force on the leg tends to tilt the cuff 4 rearward, that is to say in the clockwise direction in the drawing, the retractable finger 8 slides along the ramp 12 and compresses the spring 9. When the force is sufficient, the retractable finger 8 reaches the end of the ramp 12, where it escapes from the housing 11 by sliding along an escape ramp 14 formed on the upper 2. This ramp 14 further makes it possible to return the cuff 4 to the position represented in the drawing.

The upper ramp 13 makes it possible to control a forward tilting force.

For the sake of simplicity, the shell, the upper and the cuff of the boot will be denoted by the same references in the embodiments below.

Figure 2:
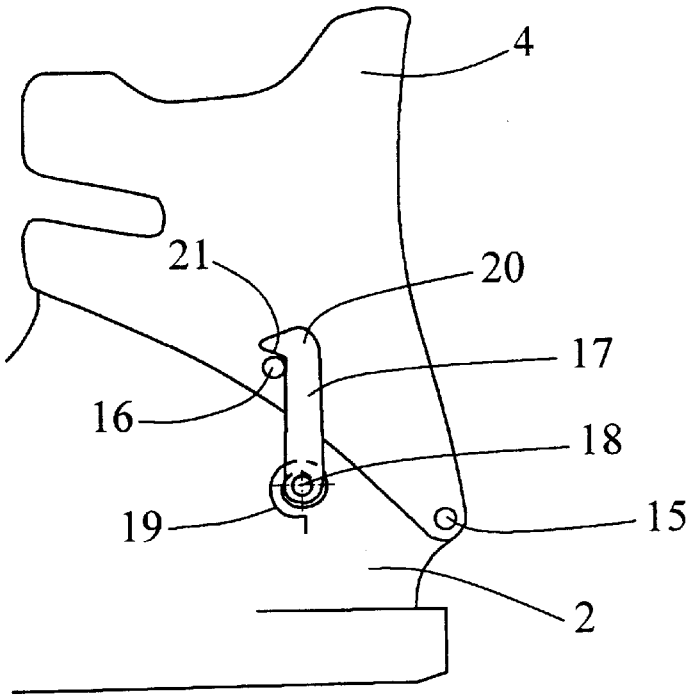
FIG. 2 is a partial view of a second embodiment.

In the embodiment represented in FIG. 2, the cuff 14 is articulated by the rear, at its lowermost point, to the upper 2 about an axle 15. On at least one side of the boot, the cuff 4 is provided with a stud or pin 16 on which a lever 17 comes to bear which is mounted so as to pivot on the upper 2 about an axle 18 and which is urged to rotate forward, that is to say in the counterclockwise direction, by a spring 19 schematically represented by a spiral spring. The end 20 of the lever 17 is in the form of a hook which bears on the pin 16 via an oblique ramp 21 rising in the direction of the lower anterior edge of the cuff 4. In other words, the slope of this ramp is such that when the cuff 4 is urged to rotate rearward, the force exerted by the pin 16 on the ramp is substantially perpendicular to this ramp. It can be resolved into two forces, one of which tends to pivot the lever 17 rearward against the action of the spring 19. The pin 16 slides over the ramp 21 and, when the force is sufficient, it escapes from the hook 20 and the cuff 4 can tilt rearward following the movement of the leg.

Figure 3:
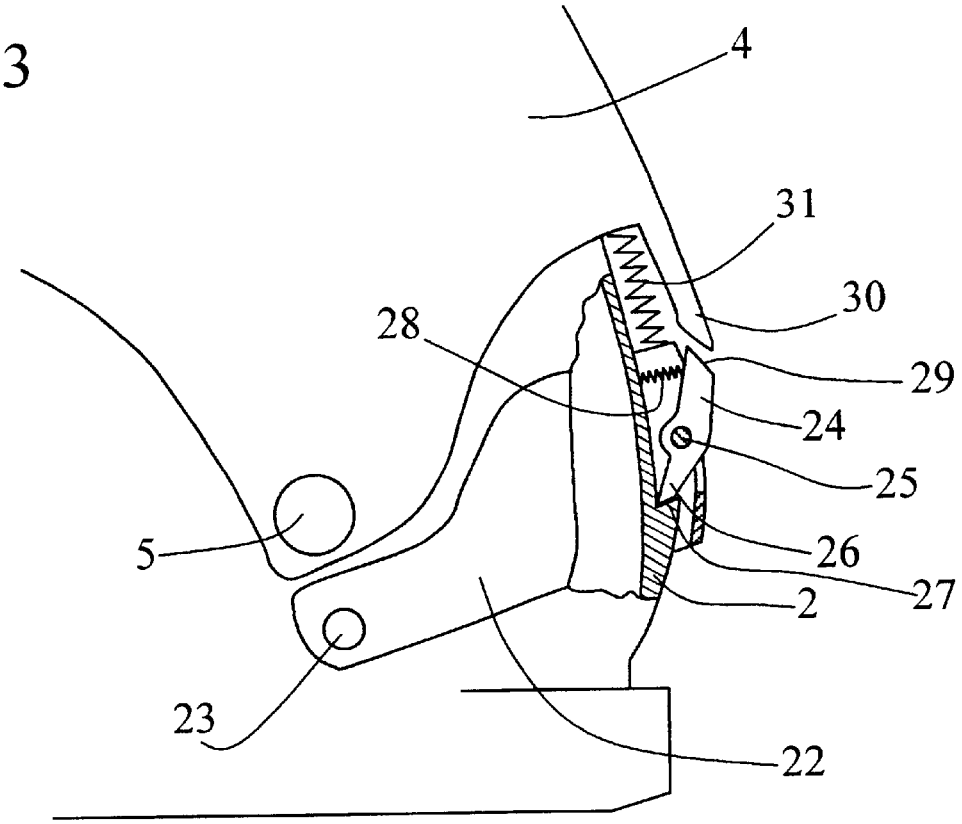
FIG. 3 is a cutaway of the rear part of a ski boot according to a third embodiment, in the resting position.

The boot according to the embodiment represented in FIGS. 3 and 4 comprises, in addition to the cuff 4 articulated at a point 5 lying in the lower malleolar region, a stirrup 22 which encloses the heel and is articulated at two opposite points 23 below the articulation 5. Such a stirrup is known in particular from the boot described in U.S. Pat. No. 4 839 973, the content of which is incorporated by reference. A catch 24 is articulated to this stirrup 22 about a horizontal axle 25. This catch 24 bears by its tip 26 on a support surface 27 of the upper 2 forming a stop. The catch 24 is held in this position by a spring 28. The end of the upper arm of the catch 24 has a ramp 29 descending rearward relative to the boot. At the rear, the cuff 4 has a continuation 30 extended downward in the direction of the ramp 29. The cuff 4 is held away from the stirrup 22 by at least one spring 31 working in compression between the cuff 4 and the stirrup 22.

When the cuff 4 is urged to tilt rearward, its part 30 abuts on the ramp 29. This pressure tends to tilt the catch 24 so as to move its tip away from the upper 2. When the pressure exerted by the cuff 4 reaches a certain value, the catch 24 escapes from its stop 27 (FIG. 4), thus allowing the stirrup 22 and the cuff 4 to tilt rearward.

It should be emphasized that the main spring is the spring 31, the spring 28 being no more than a return spring for the catch. The force of this spring 28 is such that the catch 24 can be easily pressed down by hand so as to make it possible to free the cuff 4 and return it to the resting or walking position.

As in the first embodiment, the precompression of the spring 31 could be adjusted using a screw-threaded plug.

The boot retaining device represented in FIGS. 5 to 9 also uses the ramp principle. The boot is once more a boot with a cuff 4 articulated at 5 in the malleolar region. The ramp of the retaining device is formed by the rounded end 32, for example in the form of a portion of a sphere, of a finger 33 with at least approximately rectangular cross section which is retained axially in an extra thickness 34 of the rear lower edge of the cuff 4 and whose axis is oriented approximately vertically. This finger 33 is engaged in a hole 35 of an extra thickness 36 of the upper 2 in which a recess 37 containing a spring 38 is formed. The upper part of this recess 37 has a frustoconically shaped taper 39. This recess contains two diametrically opposite balls 40 rotationally retained about an axis of the recess by grooves (not shown). These balls 40 bear on a metal washer 41, itself bearing on the precompressed spring 38. In the resting position (FIG. 6), the balls 40 are in abutment against the upper front of the recess 37 and prevent the finger 33 from passing freely between the balls, when the finger is oriented as represented in FIG. 6.

In this position of the finger 33, when the cuff 4 is strongly urged to tilt rearward, the finger 33 pushes the balls 40 downward and compresses the spring 38. As they move down, the balls 40 move away from one another because of the conicity of the part 39. At a given moment, the balls will be far enough away from one another to allow the finger 33 to pass through and correspondingly allow the cuff 4 to tilt.

If the finger 33 is rotated about its axis, for example through 90°, as represented in FIG. 8, the finger 33 can pass freely and effortlessly between the balls 40. A relaxation or walking position is thus obtained. In order for it to be rotated, the finger 33 is quite simply provided with a knurled head 42 having two positioning markers.

The bottom of the recess 37 could be provided with a screw-threaded plug for adjusting the precompression of the spring 38.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A ski boot comprising a first component (1), having a sole and an upper (2) which encloses the foot and the malleolar region, and a second component (4) having a lower-leg cuff (4) which is articulated with respect to the upper so as to allow the cuff to move from front to rear and vice versa, and means for retaining the cuff which resist the rearward tilting of the cuff but give way when the force tending to tilt the cuff exceeds an adjustable preset value, wherein the retaining means includes a ramp (12; 21; 29; 32) which is integral with one of the components of the boot and against which a bearing element (8; 16; 30; 40) integral with the other component of the boot bears, the ramp and the bearing element being capable of pushing one another against the action of an elastic means (9; 19; 31; 38) so as to allow the cuff to tilt, said retaining means having an escape position allowing the cuff to tilt freely rearward.

2. The ski boot as claimed in claim 1, the cuff of which being articulated to the upper in the malleolar region, wherein the ramp (12) is situated on the back of the upper and is followed by a compensating reverse ramp (14), and the bearing element consists of a retractable finger (8) mounted in the cuff at least approximately perpendicular to the upper.

3. The ski boot as claimed in claim 2, wherein a spring (9) bears against a screw (10) allowing the force of the spring to be adjusted.

4. The ski boot as claimed in claim 2, wherein said ramp (12) forms a lower side of a recess (11) whose upper side is also formed with a ramp (13) for forward retention of the cuff.

* * * * *

UNITED STATES PATENT AND TRADEMARK OFFICE

CERTIFICATE OF CORRECTION

PATENT NO. : 6,298,584 B1
DATED : October 9, 2001
INVENTOR(S) : Bauvois

It is certified that error appears in the above-identified patent and that said Letters Patent is hereby corrected as shown below:

Title page,
Item [73], Assignee, replace "Skis Rossignol S.A., Voiron (FR)" by -- Lange International S.A., Fribourg (CH) --

Signed and Sealed this

Thirtieth Day of July, 2002

*Attest:*

*Attesting Officer*

JAMES E. ROGAN
*Director of the United States Patent and Trademark Office*